US009945597B2

(12) United States Patent
Sandkoetter et al.

(10) Patent No.: US 9,945,597 B2
(45) Date of Patent: Apr. 17, 2018

(54) REFRIGERATION SYSTEM FOR COOLING A CONTAINER

(75) Inventors: Wolfgang Sandkoetter, Berlin (DE); Dieter Mosemann, Schildow (DE)

(73) Assignee: GEA REFRIGERATION GERMANY GMBH (DE)

( * ) Notice: Subject to any disclaimer, the term of this patent is extended or adjusted under 35 U.S.C. 154(b) by 542 days.

(21) Appl. No.: 13/808,213

(22) PCT Filed: May 28, 2011

(86) PCT No.: PCT/EP2011/002649

§ 371 (c)(1),
(2), (4) Date: Jan. 3, 2013

(87) PCT Pub. No.: WO2012/003906

PCT Pub. Date: Jan. 12, 2012

(65) Prior Publication Data

US 2013/0104582 A1 May 2, 2013

(30) Foreign Application Priority Data

Jul. 9, 2010 (DE) ..... 10 2010 026 648

(51) Int. Cl.
*F25B 41/00* (2006.01)
*F25B 49/00* (2006.01)
(Continued)

(52) U.S. Cl.
CPC ..... *F25B 49/022* (2013.01); *F25B 1/10* (2013.01); *F25B 41/04* (2013.01);
(Continued)

(58) Field of Classification Search
USPC ..... 62/196.1, 196.3, 196.2, 510, 229, 200, 62/228.1, 228.4, 228.5
See application file for complete search history.

(56) References Cited

U.S. PATENT DOCUMENTS 3,759,052 A * 9/1973 Inoue ..... 62/115
4,730,464 A 3/1988 Lotz
(Continued)

FOREIGN PATENT DOCUMENTS

DE 36 20 847 A1 2/1987
DE 91 10 982 U1 10/1991
(Continued)

OTHER PUBLICATIONS

International Search Report dated Dec. 29, 2011 issued in corresponding International Patent Application No. PCT/EP2011/002649.

(Continued)

*Primary Examiner* — Larry Furdge
(74) *Attorney, Agent, or Firm* — Ostrolenk Faber LLP

(57) ABSTRACT

The present disclosure relates to a refrigeration system for cooling the interior of a mobile refrigerated space, for example a refrigerated container, comprising two speed-controlled compressors, which can be operated in parallel as a single stage or one after the other as two stages by one controllable bypass line per compressor and a controllable valve device between the pressure side and the suction side of each compressor. The valve devices receive signals from a controller having algorithms, into which the usage temperature and ambient temperature are fed as a target value or measured value. The most energy-efficient operating modes and the rotational speeds of the compressors result from the requirements profile of the container refrigeration.

9 Claims, 4 Drawing Sheets

(51) Int. Cl.

| | |
|---|---|
| ***F25B 49/02*** | (2006.01) |
| ***F25B 1/10*** | (2006.01) |
| ***F25B 41/04*** | (2006.01) |
| *F25D 11/00* | (2006.01) |

(52) U.S. Cl.
CPC . *F25B 2309/061* (2013.01); *F25B 2400/0401* (2013.01); *F25B 2400/075* (2013.01); *F25B 2400/13* (2013.01); *F25D 11/003* (2013.01)

(56) References Cited

U.S. PATENT DOCUMENTS

| | | | | |
|---|---|---|---|---|
| 5,577,390 | A * | 11/1996 | Kaido et al. | 62/228.5 |
| 5,626,027 | A * | 5/1997 | Dormer et al. | 62/175 |
| 6,843,066 | B2 * | 1/2005 | Lee et al. | 62/175 |
| 7,114,932 | B1 * | 10/2006 | Bassine | 418/268 |
| 2006/0225445 | A1 | 10/2006 | Lifson et al. | |
| 2007/0220915 | A1 * | 9/2007 | Heyl | 62/324.1 |
| 2009/0038309 | A1 * | 2/2009 | Cocca et al. | 60/603 |
| 2010/0242527 | A1 | 9/2010 | Thogersen et al. | |

FOREIGN PATENT DOCUMENTS

| | | | |
|---|---|---|---|
| DE | 297 22 052 | | 5/1998 |
| DE | 100 47 282 | A1 | 10/2001 |
| DE | 20 2007 008 764 | U1 | 11/2007 |
| EP | 0 664 426 | | 7/1995 |
| EP | 2 088 388 | A1 | 8/2009 |
| EP | 2088388 | A1 * | 8/2009 |
| KR | 100 865 093 | B1 | 10/2008 |

OTHER PUBLICATIONS

German Office Action, dated Jun. 25, 2015, issued in corresponding German Patent Application No. 10 2010 026 648.5. Total 8 pages.

* cited by examiner

2
Liquid
Vapor
Saturated Vapor
3
1
4

Fig.4
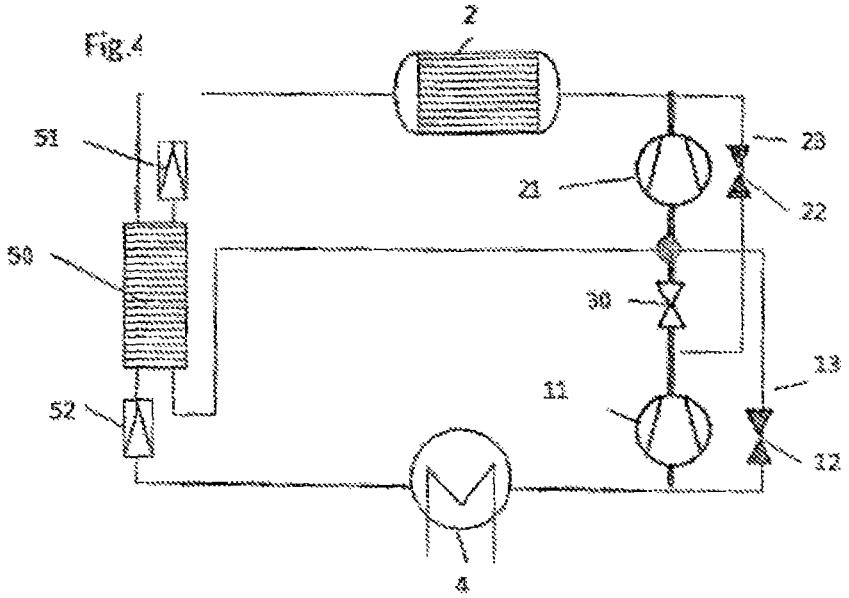
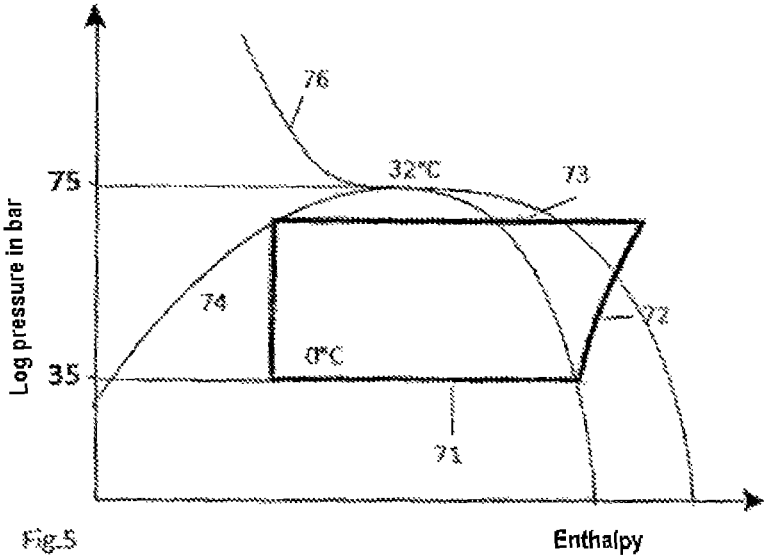
Fig.5

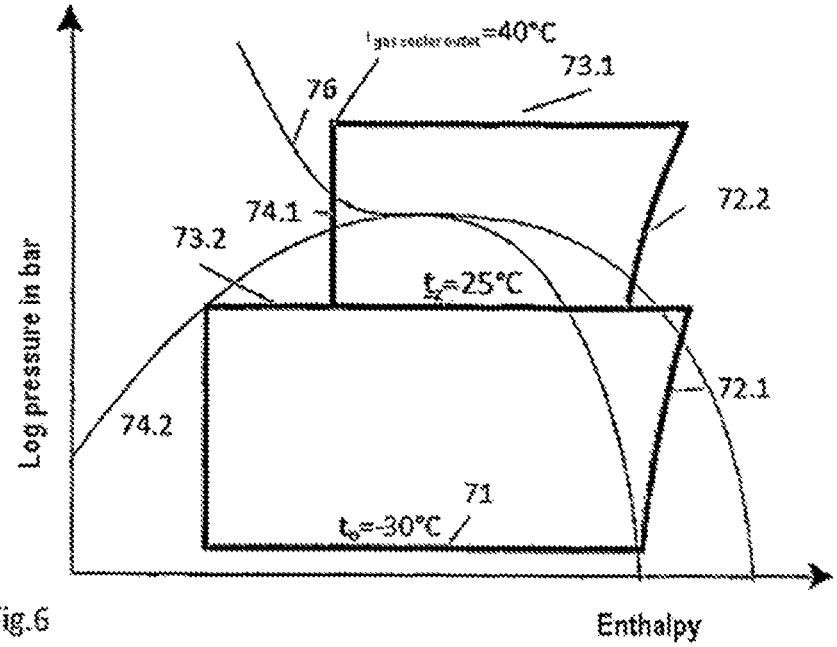
Fig.6
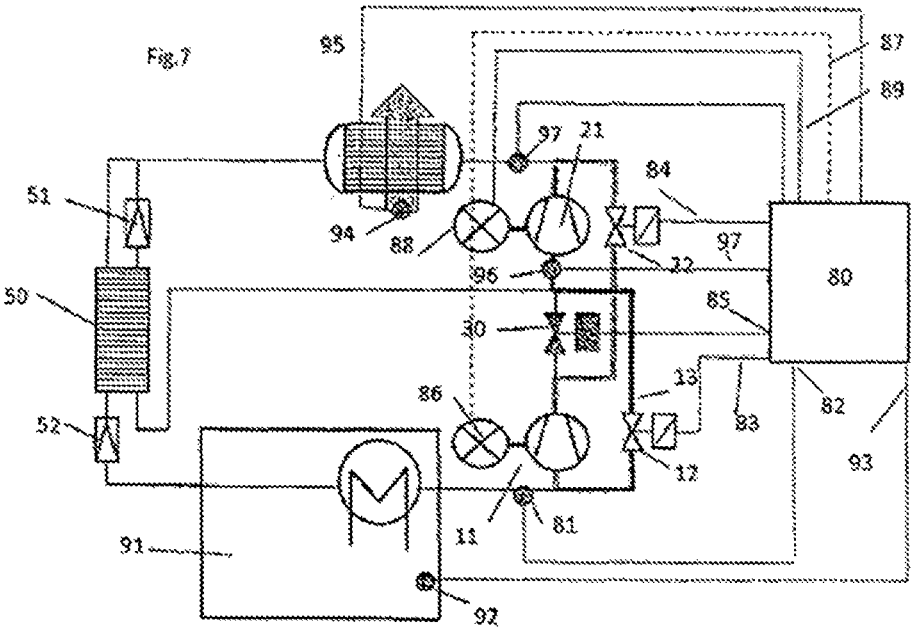

REFRIGERATION SYSTEM FOR COOLING A CONTAINER

CROSS-REFERENCE TO RELATED APPLICATIONS

The present application is a 35 U.S.C. § 371 national phase conversion of PCT/EP2011/002649, filed May 28, 2011, which claims priority of German Application No. 10 2010 026 648.5, filed Jul. 9, 2010, the contents of which are incorporated by reference herein. The PCT International Application was published in the German language.

BACKGROUND OF THE INVENTION

The invention relates to a refrigeration system for cooling the interior of a mobile cooling chamber, for example of a container which can be used universally, for example, on ships, or of a truck, a small transporter, or a cooling wagon, said refrigeration system being part of a cooling chain for transporting cooled and frozen products. The invention therefore relates to a refrigeration system for cooled transportation. For said cooling chambers, the terms container interior, container or cooling container are used in the text below. Accordingly, the term container cooling system is used to represent said mobile cooling chambers to be cooled.

The conducting of cooling air and basic construction of cooling containers for ships are described in DE 202007008764. The interior of a cooling container is surrounded by thermally insulated side walls, a roof and base, wherein the inner base is generally also designed with air distribution devices, for example longitudinal ribs, which form passages for the conduction of cold air.

Cooling containers also have to be constructed in such a manner that they can be transported by road, sea or rail by the relevant transportation systems in each case (truck-trailer reefers, marine reefers or rail reefers).

In this case, the usable temperature of such a container interior is dependent on the cargo to be cooled. Such cooling containers have to be capable of carrying out cargo cooling or freezing processes and then of keeping the cargo at a predetermined level, the cooling storage temperature.

The refrigerating capacity during the cooling or freezing process and during cooling transportation storage differs very significantly for the same container size depending on the product properties and usable temperature level in the container interior.

During the cooling transportation of a container, different climatic ambient conditions generally prevail at the outer wall of the container, said ambient conditions being caused regionally by passing through different climate zones or simply by the diurnal variation in the temperature, and therefore the temperature level of the heat sink changes and thus so does the condensation temperature of the refrigeration system for the container cooling system.

As a result, it has to be possible for the refrigeration system for the container cooling system to be operated efficiently and to be variable in such a manner that the refrigerating capacity and usable temperature can be varied and operation can be carried out economically and in an environmentally friendly manner at the different condensation temperatures without any restrictions.

The cooling container with its refrigeration system has to be operable in a container stack and the operating regime thereof has to be adaptable individually to the transported product to be cooled.

In addition, the amount of space required by, and mass of, a mobile refrigeration system should be as small as possible.

In refrigeration systems for the container cooling system use is made, according to the prior art, of single-stage or two-stage refrigeration systems which have compressors, condensers, expansion devices and evaporators.

The container is directly cooled by circulating refrigerant by means of which heat from the chamber to be cooled is absorbed at the evaporator. For this purpose, the refrigerant is compressed in one or more stages, in one or more compressors, to a higher pressure and therefore to a condensation temperature above the heat sink (container surroundings) and is then cooled in a gas cooler or in a condenser by dispensing heat to the surroundings and is then expanded again in one or more stages to the pressure in the evaporator, thus producing liquid refrigerant and flash vapor at the lower evaporation temperature of the refrigerant. This arrangement is embodied in each case only in a single stage or only in multiple stages, and therefore said refrigeration system is not suitable, either in the single-stage embodiment, or in the two-stage embodiment for the desired breadth of use of a cooling container.

U.S. Pat. No. 4,730,464 describes a cooling system for cooling a chamber with air, comprising a compressor and a turbocharger. However, the variability of the refrigeration system is extremely limited in respect of refrigerating capacity and evaporation temperature.

DE 3620847 discloses an absorption refrigeration system which is supplemented by a heat exchanger tube solar collector. The lack of possibility of being able to stack such a cooling container is disadvantageous for use on ships.

Container cooling systems with storage action but without dedicated refrigeration, with what is referred to as indirect cooling, are also known. In this case, the refrigerating medium is cooled away from the container and is subsequently introduced into cavities on the container. According to DE 29722052, slurry ice, also referred to as binary ice, cools the wall of the container. In this case, the cooling temperature is defined by the ice, which consists of water and additives, and therefore is not very variable. The cooling of an individual container at a different temperature is not possible, and the cooling duration is limited.

In addition, ice and liquid are not distributed homogeneously in the generally vertical walls.

DE 9110982U1 discloses a container cooling system and the passage system, which is required for this purpose, using cooled water which is provided by a cold water production system without heat exchangers on the cooling container coming into contact with fluorinated hydrocarbons. The container, disadvantageously, cannot be used independently.

By using water as the refrigerating medium, the use of this patent is directed towards the transportation of products above freezing point. This also restricts the use of the cooling container.

In EP0664426, the wall of the container is provided with tubular heat exchanger surfaces through which a heat exchanger fluid is conducted with a phase change. The cooling process is very sluggish, and therefore it is not possible to achieve cooling in a manner suitable for the requirements.

SUMMARY OF THE INVENTION

It is an aim and object of the present invention to provide a refrigeration system for universal cooling of the interior of a container, the usable temperature of which can be adapted within wide limits to the requirements of the cooled products such that cooling or freezing processes and storage of the products are possible at an individually predetermined temperature level.

A further aim of the invention is a refrigeration system for cooling the interior of a container, the usable temperature level of which refrigeration system and the refrigerating capacity of which can be adapted during the cooling or freezing process and during cooling transportation storage.

A further aim of the invention consists in being able to operate the refrigeration system without restrictions during container transportation under very different climatic conditions, even in a container stack.

A further aim of the invention consists in the refrigeration system for the container cooling system being variable in such a manner that the usable temperature and refrigerating capacity can be adapted so as to meet requirements and operation can be carried out economically and in an environmentally manner at the different condensation temperatures without any restrictions.

The refrigeration system according to the invention has at least two speed-controlled compressors, a gas cooler, at least one throttling point, at least one inner heat exchanger or an intermediate pressure liquid separator, an evaporator and controllable valve devices with opening and closing functions, which change the relative arrangement of the compressors with respect to each other and therefore change the circulation of the refrigerant in the refrigeration system by opening and closing.

According to the features of the invention, a first controllable valve device is arranged on a first compressor as a controllable bypass between the suction and pressure sides, a second controllable valve device is arranged on a second compressor as a controllable bypass between the suction and pressure sides, and a third controllable valve device is arranged between the pressure side of the first compressor and suction side of the second compressor.

According to the features of the invention, the communicating connection of the first controllable valve device opens on the pressure side of the first compressor after (downstream of) the third controllable valve device and the communicating connection of the second controllable valve device branches off on the suction side of the second compressor before (upstream of) the third controllable valve device.

By changing the opening and closing position of the controllable valve devices, the compressors can be operated optionally in parallel, i.e. at the same intake pressure and at the same counterpressure, or successively, as a result of which one compressor operates as the first compression stage (LP or low pressure compressor) and the second compressor operates as the second compression stage at a higher pressure level (HP or high pressure compressor).

As a result of the changed opening and closing positions of the controllable valve devices and by changing the speed of the compressors, the usable temperature, refrigerating capacity and pressure ratio of the compressors can be adapted to requirements within wide limits.

For container transportation of fresh produce, for example fruit, vegetables or else meat, the refrigeration is realized in a single stage, since the usable temperature still lies above freezing point. For this purpose, one of the two compressors is operated by itself in order to maintain the usable temperature, or the two compressors are operated in parallel to lower the temperature from the introduction temperature to a usable temperature. In this case, the first and the second controllable valve devices are open and the third controllable valve device is closed. If the two compressors operate in parallel, they operate at the same pressure level on the suction and pressure sides thereof. This operation is referred to here as the NK operating mode.

For container transportation of frozen products, i.e. at usable temperatures significantly below freezing point, the refrigeration is realized in two stages. For this purpose, the first and the second controllable valve devices are closed and the third controllable valve device is opened. This operation is referred to here as the TK operating mode.

In the TK operating mode, the intake pressure of the first compressor, which forms the first compression stage and is referred to as the low pressure compressor or LP compressor, is roughly equal to the evaporation pressure, and the counterpressure of the LP compressor is roughly equal to the intake pressure of the second compressor, which forms the second compression stage and is referred to as the high pressure compressor or HP compressor. The two compressors operate at different pressure levels on the suction and pressure sides thereof.

The counterpressure of the HP compressor is the highest pressure of the refrigeration system. At pressures which are lower than the critical pressure of the refrigerant used in the refrigerating circuit of the refrigeration system, the pressure level of said compressor corresponds directly to the condensation temperature, or, at pressures above the critical pressure of the refrigerant used, the pressure is controlled in dependence on the gas cooler outlet temperature.

After leaving the gas cooler, the refrigerant, which is under high pressure, is cooled in the inner heat exchanger by a partial refrigerant stream, which is expanded to the pressure level after the LP compressor, before said refrigerant is expanded to the suction pressure of the LP compressor. The partial refrigerant stream evaporates by absorbing heat from the refrigerant under high pressure. Said vaporous partial refrigerant stream emerging from the inner heat exchanger is supplied to the LP compressor on the pressure side. It is then conveyed at the highest pressure level from the HP compressor into the gas cooler.

The pressure after the LP compressor determines the cooling rate of the refrigerant under high pressure. Said pressure arises from the relationship of the volumetric flows from the LP and HP compressors and can be adapted in respect of the most economical operating method by speed control of the two compressors.

The NK and TK operating modes can advantageously be combined for storing uncooled produce in order to accelerate the cooling rate to a certain temperature by means of a very large refrigerating capacity. For this purpose, the NK operating mode is realized first of all until a predetermined temperature is reached in the cooling temperature. In this case, the controllable valve devices are opened or closed, as described above for the NK operating mode. The two compressors operate at identical pressure levels on the suction and pressure sides thereof. The change is then made to the TK operating mode, as a result of which the pressure levels of the two compressors change, the refrigerating capacity drops and the refrigeration efficiency increases. In this case, the controllable valve devices are opened or closed, as described above for the TK operating mode. This combination of the two operating modes—the NK and TK operating modes—will be referred to here as the "cooling-down" mode.

Even in the starting phase for the TK operating mode without a "cooling-down" mode, the three controllable valve devices are opened or closed according to the NK operating mode, although only one of the two compressors is put into operation. The NK operating mode is maintained until the intake pressure has reached a predetermined desired magnitude. Only then are the three controllable valve devices opened or closed according to the TK operating mode, and the second compressor is put into operation as the LP compressor. The two compressors then operate at different pressure levels.

In an advantageous manner, the natural refrigerant $CO_2$ can be used in the refrigerating circuit, the direct greenhouse potential of which has the value 1 and the heat of evaporation of which, per cubic meter of vapor volume taken in, is approximately ten times greater than that of R134a.

As a result, the compressors and piping cross sections can be of very small dimensions. The refrigeration system for mobile cooling containers can be designed to be highly compact and space-saving. Inner heat exchangers or intermediate pressure liquid separators are arranged as described in the exemplary embodiment, and therefore the known advantages of a $CO_2$ refrigeration system are realized for an economical operating method.

The following examples are intended to illustrate how the controllable valve devices change the function of the refrigeration system.

The arrangement according to the invention of the compressors can be combined with known arrangements of further system components. These are system embodiments with an intermediate cooler, intermediate pressure liquid separator, and economizer connection to the compressor or intermediate pressure feeding between the compressors. The following examples are intended to illustrate that the teaching of the invention is applicable without restrictions for a wide variety of different system configurations.

BRIEF DESCRIPTION OF THE DRAWINGS

FIG. 4 illustrates the arrangement of the compressors in the TK operating mode according to the invention in a refrigeration system with an inner heat exchanger.

FIG. 5 shows the single-stage refrigerating circuit process for the NK operating mode with a small temperature difference between the heat sink and usable temperature (the two compressors operate in a single stage in parallel).

FIG. 6 shows the two-stage refrigerating circuit process for the TK operating mode with a large temperature difference between the heat sink and usable temperature (one compressor is the LP compressor and one compressor is the HP compressor).

FIG. 7 shows an arrangement according to the invention with a controller, with one of the two possible operating modes (NK operating mode) being illustrated.

DESCRIPTION OF PREFERRED EMBODIMENTS

Figure 1:
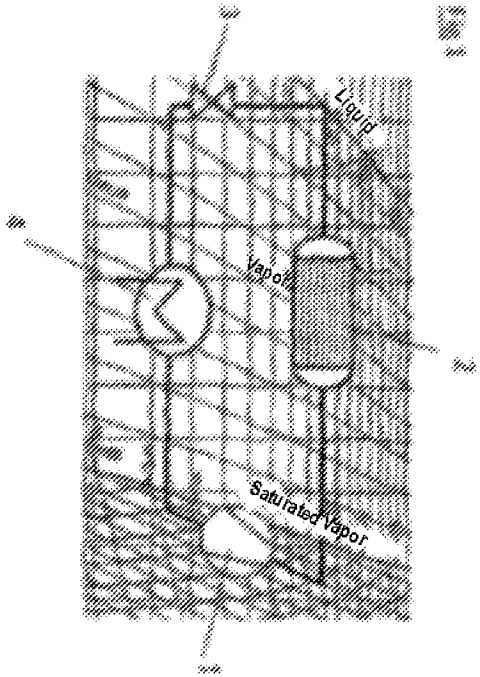
FIG. 1 shows, in highly simplified form, a known single-stage refrigerating circuit process with the refrigerant R134a, illustrated in an excerpt of a pressure/enthalpy diagram (lg p,h diagram) with the four circuit components of a refrigeration system.

According to FIG. 1, the compressor 1 (of the piston compressor, scroll compressor or rotating piston compressor type) raises the pressure from evaporation pressure to condensation pressure, which is determined by the temperature of the heat sink and by the refrigerant. By removing heat to the heat sink, for example to the surroundings, the refrigerant in the heat exchanger 2 is liquefied and is then expanded into the evaporator 4 at the throttling point 3. In the process, flash vapor and liquid are produced. The liquid evaporates by absorbing heat from the container interior and therefore cools the container interior.

The broad demands imposed on a container cooling system cannot be met by said single-stage embodiment. The two-stage embodiment would not eliminate this disadvantage, since said embodiment has use limits deviating therefrom.

Figure 2:
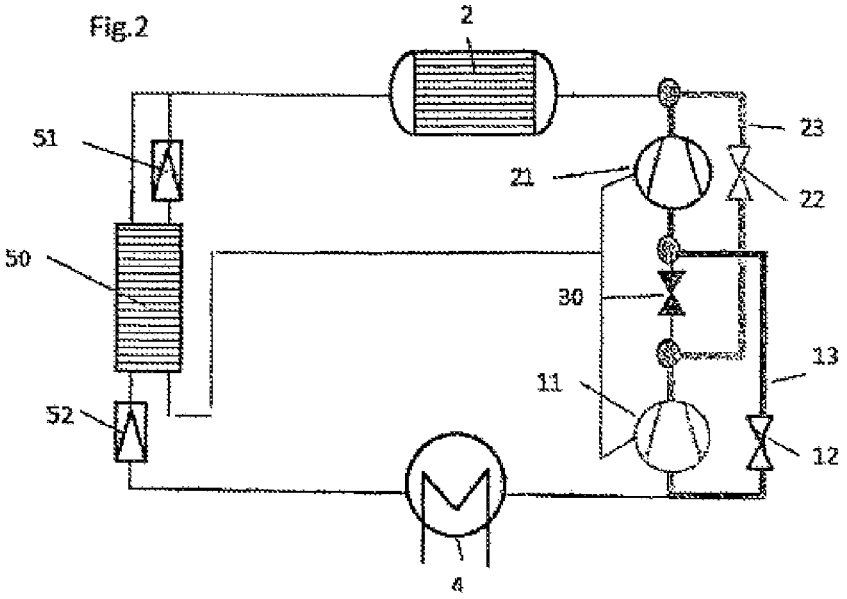
FIG. 2 illustrates the arrangement of the compressors in the NK operating mode according to the invention. The compressors here operate in a refrigeration system with a liquid supercooler (liquid sub-cooler). In addition to the intake connecting stub, said compressors have a second connection, an economizer connection, via which fluid can be fed into the working chambers if the pressure is of a sufficient magnitude. This permits multi-stage refrigeration system operation.

FIG. 2 illustrates a refrigeration system with the components thereof which, according to the invention, permit alternatively single- and two-stage operation of the refrigeration system for the container cooling system, i.e. they can be operated either in the NK or TK operating mode. The NK operating mode is emphasized by thick lines.

In addition to the heat exchanger 2, which operates as a condenser or gas cooler depending on the temperature level in relation to the critical temperature of the refrigerant, the evaporator 4, compressors 11 and 21, which are operated at a higher or lower speed depending on the power requirements or depending on operating conditions, a first controllable bypass 13 and a second controllable bypass 23 and also the first controllable valve device 12, the second controllable valve device and the third controllable valve device 30 are illustrated.

The first controllable valve device 12 is arranged on the first compressor 11 as a controllable bypass 13 between the suction and pressure sides thereof, the second controllable valve device 22 is arranged on the second compressor 21 as a controllable bypass 23 between the suction and pressure sides thereof, and a third controllable valve device 30 is arranged between the pressure side of the first compressor 11 and suction side of the second compressor 21.

The communicating connection of the first controllable bypass 13 opens on the pressure side of the first compressor 11 after (downstream of) the third controllable valve device 30 and the communicating connection of the second controllable bypass 23 branches off on the suction side of the second compressor 21 before (upstream of) the third controllable valve device 30.

By changing the opening and closing positions of the controllable valve devices 12, 22, 30, the compressors 11, 21 can be operated optionally in parallel, i.e. at the same intake pressure and at the same counterpressure, or successively, as a result of which, in this case, the first compressor 11 operates as the first compression stage (LP or low pressure compressor) and the second compressor 21 operates as the second compression stage at a higher pressure level (HP or high pressure compressor).

In FIG. 2, the controllable valve devices 12 and 22 are open and the controllable valve device 30 is closed. In this operating mode, which is referred to as NK, the two compressors 11 and 21 are operated in parallel. The two compressors operate at the same intake pressure and at the same counterpressure with single-stage compression.

The example refers to the use of scroll compressors with an intermediate pressure connection, what is referred to as an economizer connection. The two compressors are of identical type and identical size with identical use limits. They are shown here in the NK operating mode and are therefore operated with single-stage compression with intermediate pressure feeding such that, after leaving the heat exchanger 2, the refrigerant is cooled in the inner heat exchanger 50 before being expanded at the first throttling point 52. The cooling is realized by a partial refrigerant stream which is expanded at the throttling point 51 to the intermediate pressure level. This increases the efficiency of the refrigerating system even in the case of single-stage compressor operation. Necessary valve devices upstream of the economizer connections of the two compressors 11 and 21 are not illustrated in the figure.

Said compressors are operated in the same refrigeration system in the TK operating mode for a different use of the container for transporting frozen produce.

Figure 3:
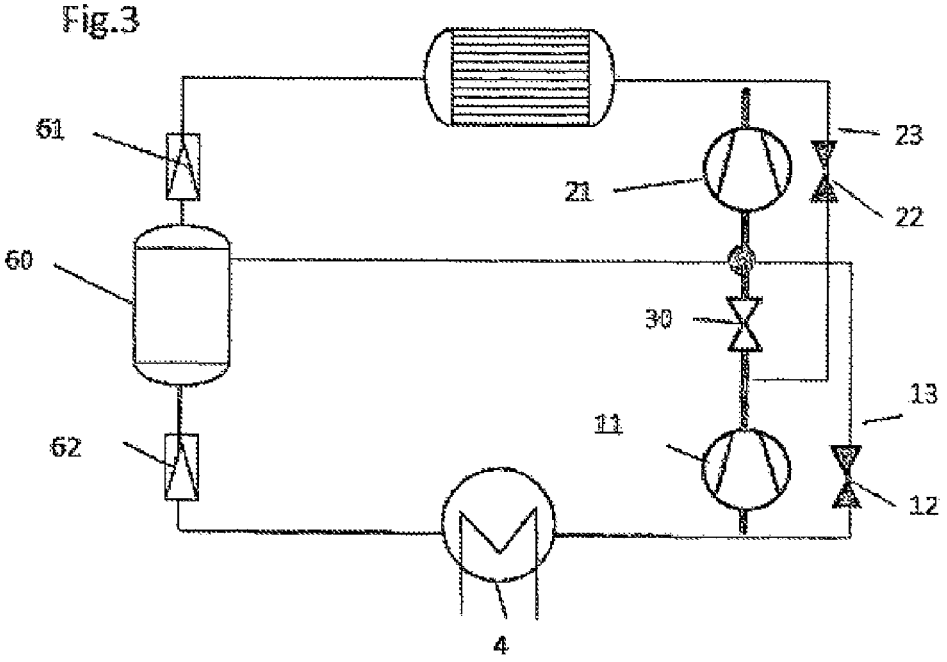
FIG. 3 illustrates the arrangement of the compressors in the TK operating mode according to the invention, this corresponding to the two-stage arrangement according to the invention. The refrigeration system has an intermediate pressure liquid separator.

FIG. 3 illustrates a refrigeration system with the components thereof which, according to the invention, permit alternatively single- and two-stage operation of the refrigeration system for the container cooling system, i.e. they can be operated either in the NK or TK operating mode. The TK operating mode for container transportation of frozen products is emphasized by thick lines.

The refrigeration is realized here in two stages. For this purpose, the first controllable valve device 12 and the second controllable valve device 22 are closed and the third controllable valve device 30 is opened. In the TK operating mode, the intake pressure of the first compressor 11 is roughly approximate to the evaporation pressure, and the counterpressure thereof is roughly approximate to the intake pressure of the second compressor 21. The two compressors operate at different pressure levels on the suction and pressure sides thereof.

The counterpressure of the compressor 21 is the highest pressure of the refrigeration system. At pressures which are lower than the critical pressure of the refrigerant used in the refrigerating circuit of the refrigeration system, the pressure level of said compressor corresponds directly to the condensation temperature, or, at pressures above the critical pressure of the refrigerant used, the pressure is controlled in dependence on the gas cooler outlet temperature.

The refrigeration system in FIG. 3 shows an intermediate pressure liquid separator 60 which permits a two-stage expansion at the throttling points 61 and 62. After the first expansion stage, the liquid and flash vapor are fed between the compressors 11 and 21 at an intermediate pressure, the desired value of which is aimed for by changing the speed of the compressor 21. This increases the refrigeration efficiency.

FIG. 4 illustrates a different refrigeration system with the components thereof, which, according to the invention, alternatively permits single- and two-stage operation for the container cooling system, i.e. can either be operated in the NK or TK operating mode. The TK operating mode is emphasized by thick lines.

The refrigeration system according to FIG. 4 shows, downstream of the heat exchanger 2, which operates as a condenser or gas cooler depending on the temperature level in relation to the critical temperature of the refrigerant, the inner heat exchanger 50, in which the refrigerant is cooled to an intermediate temperature before it is expanded at the throttling point 52. For this purpose, a partial refrigerant stream is expanded at the throttling point 51 to an intermediate pressure, the desired value of which is controlled by the speed of the compressor 21. The refrigeration efficiency is increased.

FIG. 5 shows the single-stage refrigerant circuit process in a pressure/enthalpy diagram for the refrigerant $CO_2$ in the NK operating mode at a heat sink temperature of less than 32° C. and a usable temperature greater than 0° C. This illustration corresponds to the operation of the compressors in the NK operating mode. Compression along the line 72, withdrawal of heat with subsequent liquefaction of the $CO_2$ along the line 73, throttle expansion along the line 74 and evaporation by absorption of heat from the container interior along the line 71 at 0° C. The usable temperature of, for example, 12° C. could therefore be realized for transportation of bananas. The line 76 illustrates the isothermal line of the critical temperature for $CO_2$.

FIG. 6 shows the two-stage refrigerating circuit process according to FIG. 3 in a pressure/enthalpy diagram for the refrigerant $CO_2$ in the TK operating mode at a heat sink temperature of greater than 32° C. and a usable temperature of greater than −32° C. This illustration corresponds to the operation of the compressors in the TK operating mode. Compression along the line 72.1 in the compressor 11 and compression along the line 72.2 in the compressor 21, withdrawal of heat in the heat exchanger 2 along the line 73.1, first stage of throttle expansion along the line 74.1 to the temperature level of 25° C. with intermediate cooling effect along the line 73.2 and second stage of the throttle expansion along the line 74.2, evaporation by absorption of heat from the container interior along the line 71 at −30° C. The usable temperature of, for example, −22° C. could therefore be realized for frozen meat. The line 76 illustrates the isothermal line of the critical temperature for $CO_2$.

FIG. 7 shows an arrangement according to the invention with a controller 80 and the most important control lines for activating the valve devices 12, 22, 30 which can be shut off and for controlling the speed of the driving motors 86, 88 for the two compressors 11, 21 and the points for measuring the temperature in the container interior at the temperature measuring point and for measuring the ambient temperature at the temperature measuring point 94, and for measuring the pressures at a pressure measuring point 81 upstream of the compressors and a pressure measuring point 97 downstream of the two compressors, and a pressure measuring point 96 downstream of the controllable valve device, the pressure in the NK operating mode being equal to the intake pressure of the second compressor, while said pressure is the intermediate pressure between the first and the second compressor in the TK operating mode.

The abovementioned measuring variables are an input variable at the controller 80. The interior temperature from the container 91 is determined at the temperature measuring point 92 as a singular variable or as an average value from a plurality of measuring points (not illustrated) and is an input variable at the input 93 of the controller 80.

The decision regarding the NK or TK operating mode falls to an algorithm in the controller, the algorithm evaluating the temperature in the container interior at the temperature measuring point 92 and the temperature for cooling air at the temperature measuring point 94, the signal of which passes via a measuring line 95 to the controller.

The NK operating mode, in which the two compressors 11 and 21 are operated in parallel, is illustrated. The controllable valve devices 12 and 22, the signals of which are output by the controller 80, are opened via the control lines 83 and 84, while the controllable valve device 30 does not obtain any signal from the controller 80 via the control line 85 and remains currentlessly closed.

The speed of the two driving motors 86, 88 of the first and second compressors 11, 22 is changed by the controller 80 via the control lines 87 for the first compressor and via the control lines 89 for the second compressor depending on a desired/actual comparison of the pressure at the pressure measuring point 81, said comparison being conducted at the input 82 to the controller, and a desired value preset in the controller 80. The controller can also use a second algorithm to control the internal temperature of the container via the desired/actual comparison.

The controller of the refrigeration system is designed in such a manner that the NK and TK operating modes can be changed during operation. This is particularly advantageous with the storage of uncooled produce in order to shorten the cooling time to a certain temperature by means of a very great refrigerating capacity and to maintain the quality of the product to be cooled.

For this purpose, the NK operating mode is first of all realized until a desired temperature is reached in the cooling container. In this case, the controllable valve devices 12, 22, 30 are opened or closed, as described above for the NK operating mode. The compressors 11, 21 operate at identical pressure levels on the suction and pressure sides thereof.

A change is then made to the TK operating mode, as a result of which the pressure levels of the compressors 11, 21 change, the refrigerating capacity drops and the refrigeration efficiency increases. In this case, the controllable valve devices 12, 22, 30 are opened or closed for the TK operating mode. The control variable for the first compressor is the pressure at the pressure measuring point 81, as described above for the NK operating mode. The speed of the second compressor is increased or reduced by the controller 80 so that the pressure at the pressure measuring point 96 very substantially corresponds to a pressure calculated from the current operating conditions at the two pressure measuring points in accordance with the relationship of the "square root of the product of pressure at the pressure measuring point 81 and pressure at the pressure measuring point 97".

The combination of the two operating modes—the NK and TK operating modes—can be operated as rapid cooling immediately after storage in the container, referred to as the "cooling-down" mode. Said cooling-down mode starts with the NK operating mode until a predetermined desired valve is reached at the pressure measuring point and then switches over to the TK operating mode.

The algorithm of the controller 80 advantageously also starts both compressors of the refrigeration system for freezer storage without rapid cooling with the NK operating mode and, as described previously, switches over to the TK operating mode.

Depending on the desired value of the usable temperature, the NK operating mode is maintained until a desired intake pressure is reached. Only then are the controllable valve devices 12, 22, 30 opened or closed in accordance with the TK operating mode, and the compressors 11, 21 operate at different pressure levels.

As a result of the changed opening and closing positions of the controllable valve devices and the change, which is associated therewith, of the operating mode from NK operating mode to TK operating mode and back, and by changing the speed of the compressors, the usable temperature in the interior of a container can be adapted within wide limits to the requirements of the cooled product in a manner suitable for requirements such that the cooling processes and the cooling and freezer storage are possible at an individually predetermined temperature level. The operating mode and usable temperature level within the cooling chamber of the container are selected in a manner suitable for requirements during the cooling transportation storage and after changing the cooled product such that the cooling container can be used efficiently. However, container transportation under very different climatic conditions due to different climate zones in a container stack is also possible without restrictions, since the selection of the operating mode takes into consideration the temperature difference, which is to be overcome, between the usable temperature and temperature of the heat sink. The refrigeration system can therefore be optimally operated within wide limits in respect of the refrigerating capacity and energy efficiency by selection of the best operating mode, and therefore operating costs can be reduced. The cooling container is therefore usable in a very variable manner within wide use limits. The refrigerating capacity can be produced with an extremely low energy requirement. The disadvantages mentioned at the beginning of known solutions are eliminated.

LIST OF THE REFERENCE NUMBERS USED

1 Compressor
2 Heat exchanger
3 Throttling point
4 Evaporator
11 First compressor
12 First controllable valve device
13 First controllable bypass
21 Second compressor
22 Second controllable valve device
23 Second controllable bypass
30 Third controllable valve device
50 Inner heat exchanger
51 Throttling point
52 Throttling point
60 Intermediate pressure liquid separator
61 Throttling point
62 Throttling point
71 Line of evaporation
72 Line of the single-stage compression
72.1 Line of the first compression stage
72.2 Line of the second compression stage
73 Line of the removal of heat
73.1 Line of the removal of heat
74 Line of the single-stage throttle expansion
74.1 Line of the first throttle expansion
74.2 Line of the second throttle expansion
76 Isothermal line of the critical temperature
80 Controller
81 Pressure measuring point
82 Input
83 Control line
84 Control line
85 Control line
86 Driving motor, first compressor
87 Control lines, first compressor
88 Driving motor, second compressor
89 Control line, second compressor
91 Container
92 Temperature measuring point
93 Input
94 Temperature measuring point
95 Measuring line
96 Pressure measuring point
97 Pressure measuring point

What is claimed is:

1. A refrigeration system for cooling the interior of a mobile cooling chamber by lowering the temperature to a usable temperature and removing heat to a heat sink, comprising:

a first and a second speed-regulated compressor that compress refrigerant;

a gas cooler;

at least one throttling point;

at least one inner heat exchanger or an intermediate pressure liquid separator;

an evaporator;

a controller;

controllable valve devices; and wherein the first compressor has a first bypass line which produces a flow connection from a pressure side of said compressor to a suction side thereof and in which a first controllable valve device with opening and closing functions is arranged, wherein the second compressor has a second bypass line which produces a flow connection from a pressure side of said compressor to a suction side thereof and a second controllable valve device with opening and closing functions is arranged, and wherein a third controllable valve device with opening and closing functions is arranged in a flow connection between the pressure side of the first compressor and the suction side of the second compressor, wherein the controller has at least inputs for usable and ambient temperatures and outputs for activating the abovementioned valve devices and for separately changing a speed of the first and second compressors, and the controller is configured to operate selectively the three valve devices to operate the first and the second compressors in series and in parallel, and is configured to change the speed of the first and the second compressor depending on the usable and ambient temperatures.

2. The refrigeration system for cooling the interior of a mobile cooling chamber as claimed in claim 1, wherein the communicating connection of the first bypass line branches off on the pressure side of the first compressor downstream of the third controllable valve device and the communicating connection of the second bypass line branches off on the suction side of the second compressor upstream of the third controllable valve device.

3. The refrigeration system for cooling the interior of a mobile cooling chamber for a single-stage operating method as claimed in claim 2, wherein the combination of the opening and closing positions is constituted in such a manner that the valve devices in the first and in the second controllable bypass line are open and that the third controllable valve device is closed, and wherein the system is for an NK operating mode.

4. The refrigeration system for cooling the interior of a mobile cooling chamber, as claimed in claim 2, wherein the combination of the opening and closing positions of the three valve devices is constituted in such a manner that the valve devices in the first and in the second controllable bypass line are closed and that the third controllable valve device is open, wherein the system is for a two-stage operating method, and wherein the system is for a TK operating mode.

5. The refrigeration system for cooling the interior of a mobile cooling chamber as claimed in claim 1, wherein the first and the second compressor are of the same type and same size.

6. The refrigeration system for cooling the interior of a mobile cooling chamber as claimed in claim 1, wherein refrigerant $CO_2$ is present in a refrigeration circuit.

7. The refrigeration system for cooling the interior of a mobile cooling chamber as claimed in claim 1, wherein the features of an NK operating mode and a TK operating mode successively form a sequence during start-up of the refrigeration system and for rapid cooling, and the refrigeration system further comprises refrigerant $CO_2$ in a refrigeration circuit.

8. The refrigeration system for cooling the interior of a mobile cooling chamber as claimed in claim 4, wherein the pressure, in the TK operating mode, between the first and the second compressor is kept to a desired value by changing the speed of the second compressor, and wherein the features of an NK operating mode and the TK operating mode successively form a sequence during start-up of the refrigeration system and for rapid cooling, and the refrigeration system further comprises refrigerant $CO_2$ in a refrigeration circuit.

9. The refrigeration system for cooling the interior of a mobile cooling chamber as claimed in claim 1, wherein an NK operating mode for differential values between the temperature of the heat sink and the usable temperature and a TK operating mode for greater differential values between temperature of the heat sink and the usable temperature are stored in the algorithm.

* * * * *